US008196899B2

(12) United States Patent
Hager

(10) Patent No.: US 8,196,899 B2
(45) Date of Patent: Jun. 12, 2012

(54) BOAT LIFT MOTOR HAVING SPLINE SHAFT

(75) Inventor: Gary Hager, Minneapolis, MN (US)

(73) Assignee: FFI Automation, Inc., Deephaven, MN (US)

( * ) Notice: Subject to any disclaimer, the term of this patent is extended or adjusted under 35 U.S.C. 154(b) by 302 days.

(21) Appl. No.: 12/691,526

(22) Filed: Jan. 21, 2010

(65) Prior Publication Data

US 2011/0049450 A1 Mar. 3, 2011

Related U.S. Application Data

(60) Provisional application No. 61/237,369, filed on Aug. 27, 2009.

(51) Int. Cl.
*B66D 1/14* (2006.01)

(52) U.S. Cl. ..... 254/343; 254/342; 254/350

(58) Field of Classification Search ..... 254/342, 254/343, 346, 350

See application file for complete search history.

(56) References Cited

U.S. PATENT DOCUMENTS 3,697,049 A * 10/1972 Wallace ..... 254/343
3,788,607 A * 1/1974 Crooks ..... 254/343
4,678,366 A 7/1987 Williamson
5,593,247 A 1/1997 Endres et al.
5,803,437 A * 9/1998 Paterson et al. ..... 254/343
5,921,529 A * 7/1999 Wilson et al. ..... 254/346
6,119,375 A * 9/2000 Wilson et al. ..... 37/195
6,435,768 B1 8/2002 Mansfield
6,767,004 B1 7/2004 Davis
7,059,803 B2 6/2006 Floe et al.
7,350,771 B2 * 4/2008 Andersen ..... 254/344
7,377,485 B2 5/2008 Davis
7,850,147 B1 * 12/2010 Fox ..... 254/343
2004/0035343 A1 2/2004 Floe et al.

* cited by examiner

*Primary Examiner* — Emmanuel M Marcelo

(74) *Attorney, Agent, or Firm* — Todd L. Juneau

(57) ABSTRACT

A boat lift motor, comprised of a motor, such motor driving worm gear reducer which, in turn, rotates a tubular drive shaft, such shaft having radial splines running its full length, both outside and inside; wherein the opposite end of the splined tubular drive shaft overlays a spline shaft mounted on the center axle/bolt of a boat winch; wherein the winch is rotated to wind and unwind a cable, rope, cord or chain; and wherein the engagement or disengagement of the power supply to the boat lift is initiated by an electronic controller, which opens and closes a relay upon the user's command, communicated via a handheld remote control or otherwise.

8 Claims, 6 Drawing Sheets

Torque Capacity Curve
SAE Straight-Tooth Splines

BOAT LIFT MOTOR HAVING SPLINE SHAFT

CROSS REFERENCE TO RELATED APPLICATIONS

This application claims priority benefit under 35 USC 119 (e) to U.S. 61/237,369 entitled Motorized Boat Lift System, filed 27 Aug. 2009, the contents of which are hereby incorporated in their entirety.

STATEMENT OF GOVERNMENTAL INTEREST

No government agency is involved in the funding, design or production of the invention

FIELD OF INVENTION

This invention relates to boat lift motors, and in particular, to motorized boat lifts having a spline shaft and controlled by electronics.

BACKGROUND

Motorized boat lifts provide the benefit of increased lift over a manually-driven lift. Small AC motors are generally cheaper than their DC counterparts, but provide inferior speed and torque control.

For example, U.S. Pat. No. 7,377,485 to Davis discloses a three-phase drive motor is utilized to operate a boat lift.

Many drive systems used in boat lifts use threaded shafts for driving a worm gear, a straight shaft using a nut and bolt coupling, or sprocket and roller chain mechanisms. U.S. Pat. No. 7,059,803 to Floe, discloses a boatlift leg and frame structure utilizing a ball screw lifting mechanism.

U.S. Pat. No. 6,033,148 to Norfolk comprises "a drive shaft carrying a drive pulley, a pulley belt entrained about the drive pulley and a driven pulley, the driven pulley being connected to a shaft of a worm gear, the worm gear being in mesh with a drive gear, and the drive gear being connected to an output shaft which is in turn connected to a reel having wound thereon a boat lift cable which is connected to a boat platform for lifting and lowering a boat resting thereon." However, a disadvantage of a worm gear is that the worm (screw) drives the gear; the gear does not drive the worm. This provides a self locking mechanism which is appropriate to certain applications, for example the winding component of a stringed instrument, where you want to hold a position. However, this can be a disadvantage when routinely raising and lowering boats on a lift.

In another example, U.S. Pat. No. 7,383,781 to Griffin discloses a boat lift system for raising and lowering a boat from and into a body of water includes a cradle, a cable and a drive system. The cradle is configured to hold the boat. Griffin discloses a drive sprocket system.

In another example, U.S. Pat. No. 4,832,210 to Wood discloses a boat lift assembly wherein the use of a conventional cable system has been replaced with a screw drive assembly.

Other prior art boatlift structures have also disclosed the use of an electronic controller, as disclosed in U.S. Pat. No. 7,059,803 to Floe. However, these and other problems disclosed in the prior art have not been adequately addressed by the prior patents.

SUMMARY

Accordingly, there is provided a novel type of spline shaft for use in this context that is employed in the subject invention, where the splines radiating from the shaft interlock directly with complementary teeth on a splined bushing centered within the boat winch to transfer torque directly to the boat winch. The spline shaft mechanism allows for superior control across the perpendicular axis of the drive shaft and avoids problems due to torsional misalignment. By transferring torque directly from the drive shaft to the winch, the need for a free-standing coupling element is also eliminated, and the prospect for deterioration of the linkage over time and resulting maintenance requirements are also lessened.

Further, the use of an electronic controller allows the power supply to the lift to be engaged or disengaged upon command of the user, either via a handheld remote control or otherwise, allowing user to set desired speed and direction. A controller system can be armored for severe conditions, such as the moisture and extreme temperature fluctuations common to boating environments. The superior control attributes of DC motors tend to make them more desirable for the controlled raising and lowering of boats from the water.

In one preferred embodiment, a motorized boat lift system utilizing a reversible DC motor power source to drive a worm gear reducer, which, in turn, rotates a tubular drive shaft, such shaft having radial splines running its full length, both inside and outside; wherein the opposite end of the hollow drive shaft overlays a splined collar covering a threaded shaft mounted in the center of a winch; wherein the winch is rotated to wind and unwind a cable, rope, cord or chain; and wherein the DC motor is engaged and disengaged by an electronic controller that opens and closes a relay based on user command, either via use of a handheld remote control or otherwise.

In another preferred embodiment, there is provided the boat lift system wherein the power supply for the boat lift is comprised of a standard DC motor with a voltage sufficient to produce the torque necessary to raise and lower boats of a certain weight.

In another preferred embodiment, there is provided a boat lift system wherein the power supply for the boat lift is comprised of a brushless DC motor with a voltage sufficient to produce the torque necessary to raise and lower boats of a certain weight.

In another preferred embodiment, there is provided a boat lift system wherein the DC motor is a 12 or 24 volt motor that draws DC power from a battery.

In another preferred embodiment, there is provided a boat lift system wherein the DC motor is a 12 volt motor that draws 120 volts of alternating current power from a standard electrical outlet or similar source.

In another preferred embodiment, there is provided the boat lift system wherein the spline transmission shaft is constructed with steel that has been subjected to a salt bath nitriding or similar treatment for rust resistance.

In another preferred embodiment, there is provided the boat lift system wherein the winch is comprised of a circular piece of steel or similar metal is centered around a threaded shaft, which shaft is threaded into a splined collar, over which the spline shaft may be engaged for torque transfer.

In another preferred embodiment, there is provided the boat lift system wherein wherein the component attaching the winch to the boat or lifting carriage is comprised of cable, rope, cord or chain made of material appropriate for maritime use.

In another preferred embodiment, there is provided the boat lift system wherein the engagement or disengagement of the power supply to the boat lift is initiated by an electronic controller, which opens and closes a relay upon the user's command, communicated via a handheld remote control or otherwise.

DETAILED DESCRIPTION OF THE INVENTION

Figure 1:
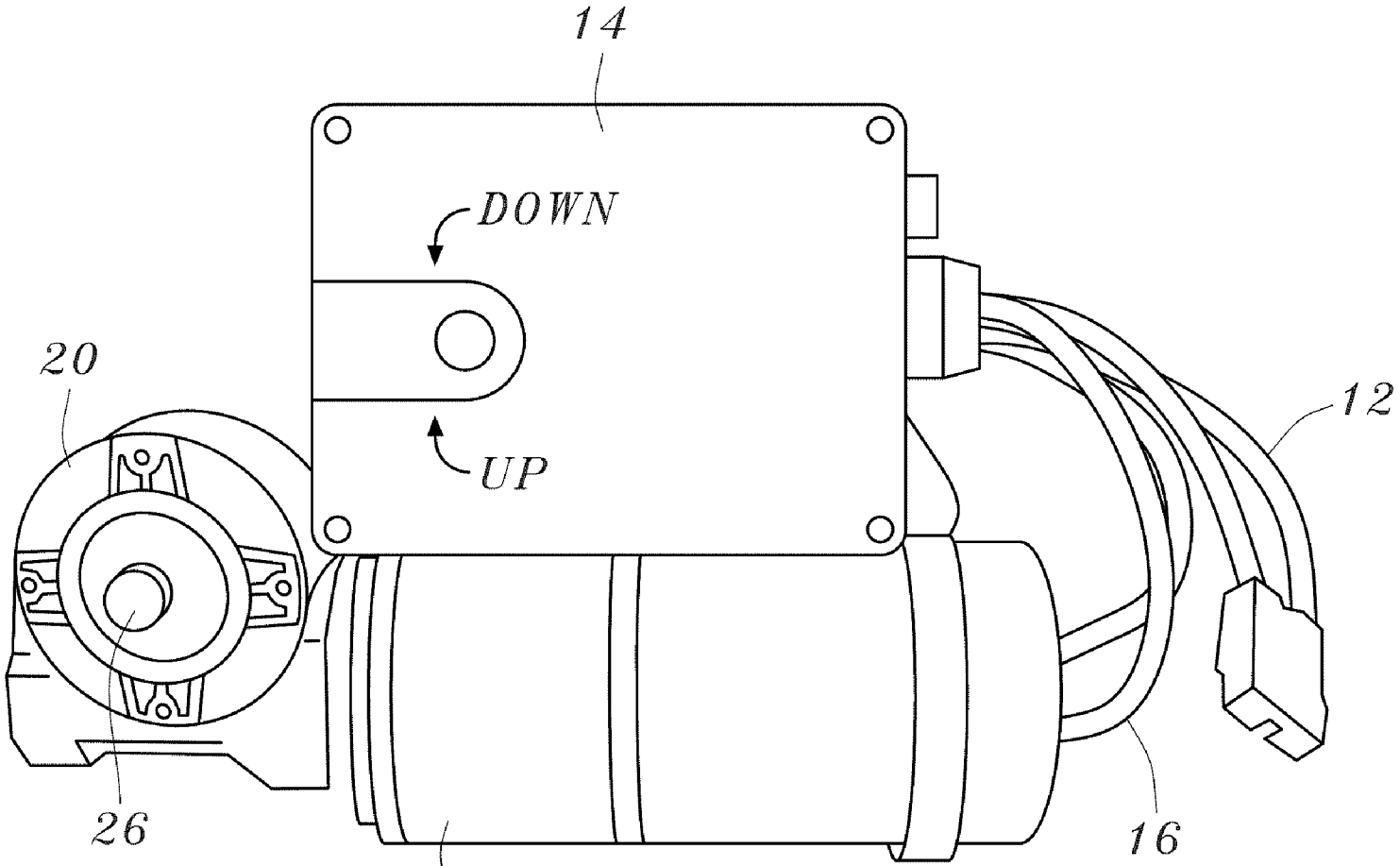
FIG. 1 is a line drawing illustrating the layout of the motor assembly of the boat lift, including the DC motor, electronics housing and worm gear reducer.

There is provided a novel type of spline shaft for use in boat lift motors, where the splines radiating from the shaft interlock directly with complementary teeth on a splined bushing centered within the boat winch to transfer torque directly to the boat winch.

DEFINITIONS

The term "spline" refers to a series of ridges on a driveshaft which mesh with and equalize the rotation speed of a mating piece, thereby transferring torque. For instance, a gear mounted on a shaft might use a male spline on the shaft that matches the female spline on the gear. In the present invention, there is a "spline shaft", which is a short piece that is directly or indirectly fitted onto a winch axle bolt. The "spline shaft" has splines on its exterior and threading on its interior. There is also a partner piece, a "splined drive shaft", which is a hollow shaft that is directly or indirectly connected to the motor and which is configured as a key way to accept the "spline shaft" into its interior using a male-female configuration.

One way of calculating the advantage of using a spline drive shaft over prior art drive shafts is to calculate the torque that can be applied.

$$\text{TORQUE in lb. ft.}=(\text{HP}\times 5250)/\text{rpm} \qquad \text{Formula I}$$

However, the structural difference between a spline and other types of gears is that a spline shaft has a number of elongated teeth along the longitudinal axis. Compared to a spur gear or worm dear, this results in a tooth having much more surface area, or effective face width. This becomes an important distinction as the load increases, the shear forces on the teeth are distributed over a larger effective face width for the spline than for other types of gears such as worm or spur gears. By having reduced shear forces, a larger load can be applied without exceeding the tolerances of the gear, including structural deformation and misalignment failures. This increased capacity may be calculated using the increased Torque Capacity from SAE spline standards, found below in Formula II:

$$\text{Torque Capacity}=(\text{psi})(N)(Da/2)(h/2)L \qquad \text{Formula II}$$

where (psi) is the psi bearing stress on the spline where N is the number of spline on the shaft where Da is the average diameter of the shaft, where Da/2=(D+d)/2, where D is the major diameter from top of spline to top of spline, and d is the minor diameter from base of tooth to base of tooth where h is the height or thickness of the material that comprises the hollow internally splined tube/shaft, and where L is the length of the shaft.

Thus, the length of the shaft, L, is directly related to the area of the effective face of the tooth, and thus, ultimately, capable of handling an increased lifting load with more efficiency.

While methods and systems of the present invention may be embodied in a variety of different forms, the specific embodiments shown in the figures and described herein are presented with the understanding that the present disclosure is to be considered exemplary of the principles of the invention, and is not intended to limit the invention to the illustrations and description provided herein.

Referring now to the FIGURES, the invention in one non-limiting preferred embodiment is comprised of a motorized boat lift powered by a reversible DC motor which powers a worm gear reducer, which in turn rotates a drive member comprised of a splined drive shaft with a hollow splined interior, wherein the internal splines on the opposite end of the hollow drive shaft overlays a splined shaft covering a threaded winch bolt attached to the interior of a winch, where the winch is attached to a cable, cord, rope or chain for lifting a boat or a carriage assembly to which a boat has been attached.

The splined drive shaft may be held in place over the spline shaft by a threaded bolt inserted through each such component.

A spacer collar may be used to create the proper distance for attaching the motor to the winch nut. The spacer collar is placed onto the winch nut, followed by the attachment of the spline shaft. Once installed, the spacer collar, ensures proper orientation of the spline shaft into the hollow splined interior of the splined drive shaft.

The motor will be attached to a relay, which relay will be opened and closed by an electronic controller, which controller will be set to engage or disengage power on command, and allow the user to set the desired speed and direction of the motor.

The power supply for the boat lift is in a non-limiting preferred embodiment comprised of a standard or brushless DC motor with a voltage sufficient to produce the torque necessary to raise and lower boats of a certain weight. In a preferred embodiment, the boat lift motor has the capacity to lift up to 7000 pounds. It is contemplated as within the scope of the invention that any appropriate motor may be used, and specifically use of the following are contemplated: an AC manually operated motor, a DC manually operated motor, an AC remote controlled motor, and a DC remote controlled motor. In one non-limiting preferred embodiment the motor is a 12V/24V motor.

The splined drive shaft is constructed of durable metal material, such as steel, but may also include other suitable materials. If the splined drive shaft is steel, it may optionally be subjected to a salt bath nitriding or similar treatment for rust resistance.

The engagement or disengagement of the power supply to the boat lift is initiated by an electronic controller, which opens and closes a relay upon the user's command, communicated via a handheld remote control or otherwise.

The winch is comprised of a circular piece of steel or similar metal is centered around a splined bushing into which the spline shaft may be inserted for torque transfer.

The component attaching the winch to the boat or lifting carriage is comprised of cable, rope, cord or chain made of material appropriate for maritime use.

Referring now to FIG. 1, FIG. 1 illustrates the motor assembly of motorized boat lift system, comprised of power input cord 12, electronic controller housing 14, power output cord 16, DC motor 18, worm gear reducer housing 20, and spline drive shaft 26.

Figure 2:
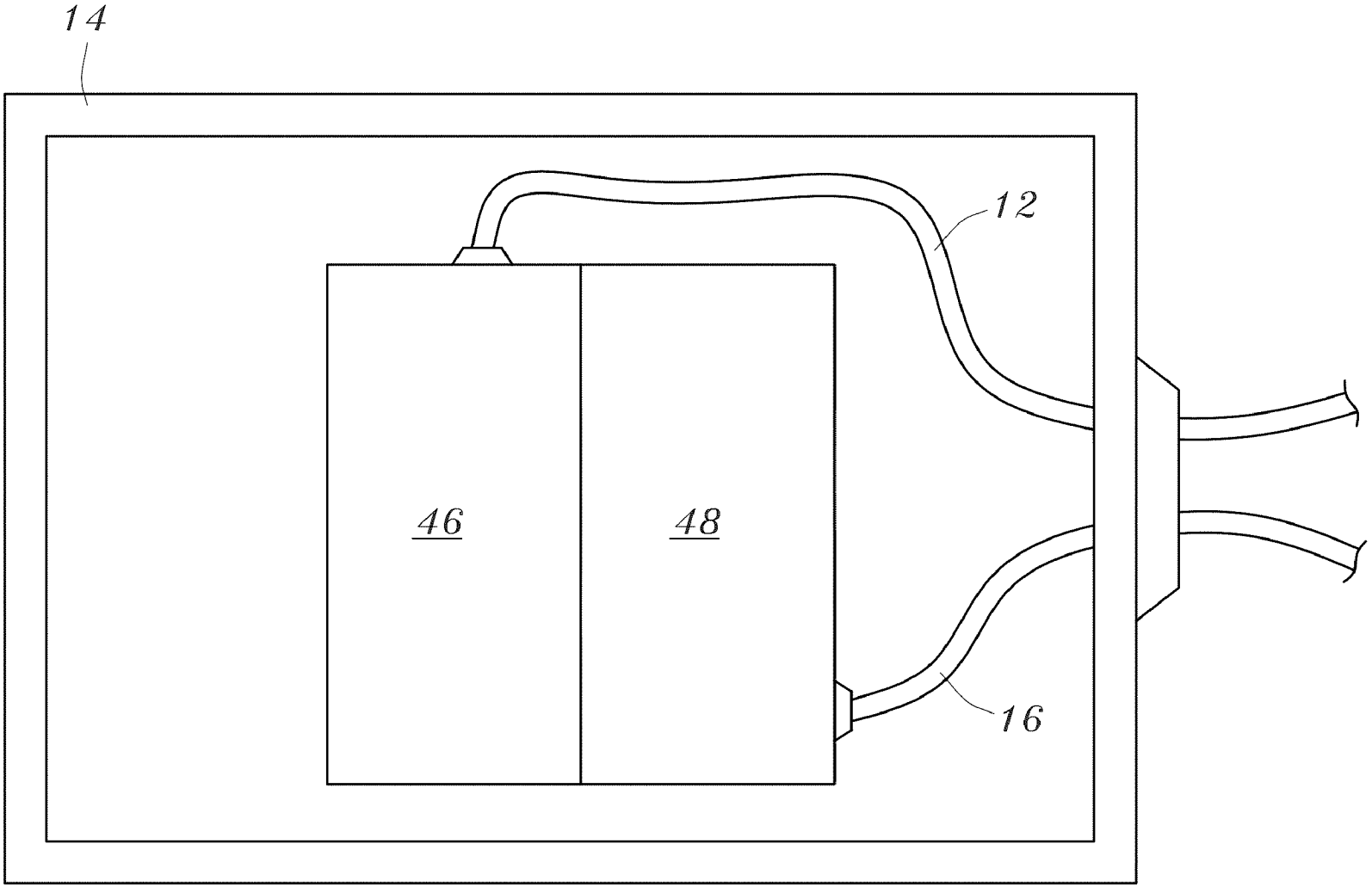
FIG. 2 is a line drawing showing the contents of the electronics housing.

As illustrated in a line drawing in, for example, FIG. 2, electronic controller housing 14 contains a portion of power input cord 12, a portion of power output cord 16, controller 46 and relay 48.

In an alternate preferred embodiment of the invention, the motor and control unit have a power outage access so the lift can be lowered or raised using an external source in a power outage. The motor 18 in FIG. 1, may have an optional access point along the axis of the internal drive, at the distal end away from the worm gear reduced housing 20. The access allows for an adapter to be installed so that an external power supply, such as battery operated power drill, can be used to lower or raise the boat lift in case of power outage to the boat lift motor described herein.

The inventive system is operated by a control or controller located within box shown in FIG. 2. The controller may be operated by switch means through turning switch seen in FIG. 2 or through the use of a remote controller having a wireless transmitter sending signals to be received by the antenna of a receiver located within box. The electrical circuitry of the present invention a processor, programmable means such an EPROM coupled to the processor. Also included in the controller is an input which receives signals either from a switch located on the box or from switches on a remote control unit (not shown) which are sent via wireless transmission. The controller also includes a power supply. The controller controls relays for controlling the motor in an up direction and in a down direction. The inventive system may also include a manual override using an external turning source, such as a battery operated power drill, that uses an attachment on the rear of the motor to connect to the shaft-assembly. Optional upper and lower limit stops may be incorporated into the manual override sub-system to disarm the power supply. Switches are used to activate the up and down motor relays. The switch may be a manual switch or a remote control switch operable in a manner well known to those skilled in the art operable remotely through some communication such as, for example, wireless transmission. The logic of the operation of the inventive system includes where turning the switch up or down operates to turn the shaft and thus raise or lower the boat lift. Pre-programming and safety limits are contemplated as within the scope of the present invention.

Figure 3:
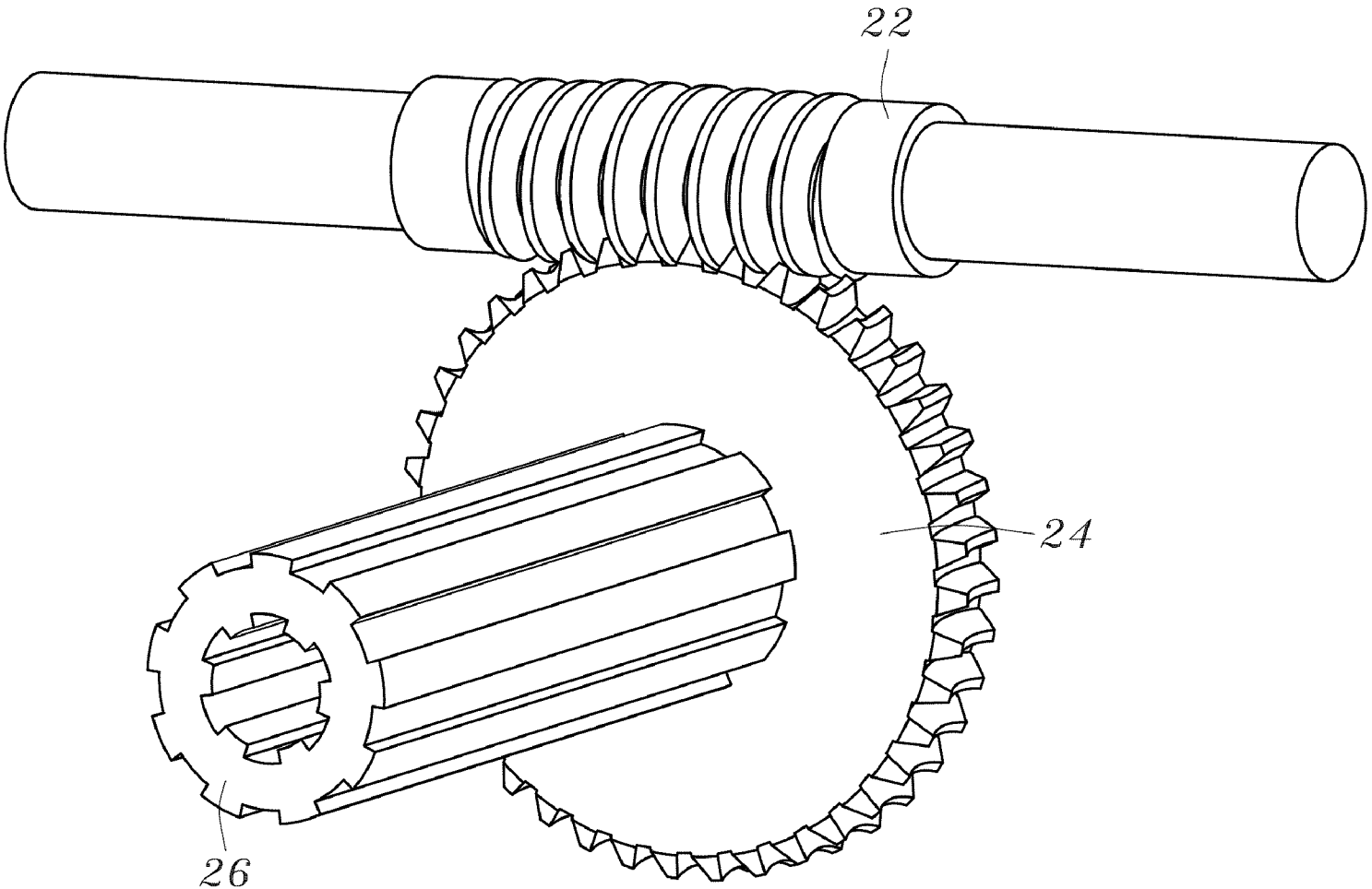
FIG. 3 is a line drawing showing the contents of the worm gear reducer housing.

As illustrated in FIG. 3, worm gear reducer housing 20 contains worm 22 and worm gear 24, while spline drive shaft 26 is mounted in the center of the worm gear and protrudes through the front of the housing.

Figure 4:
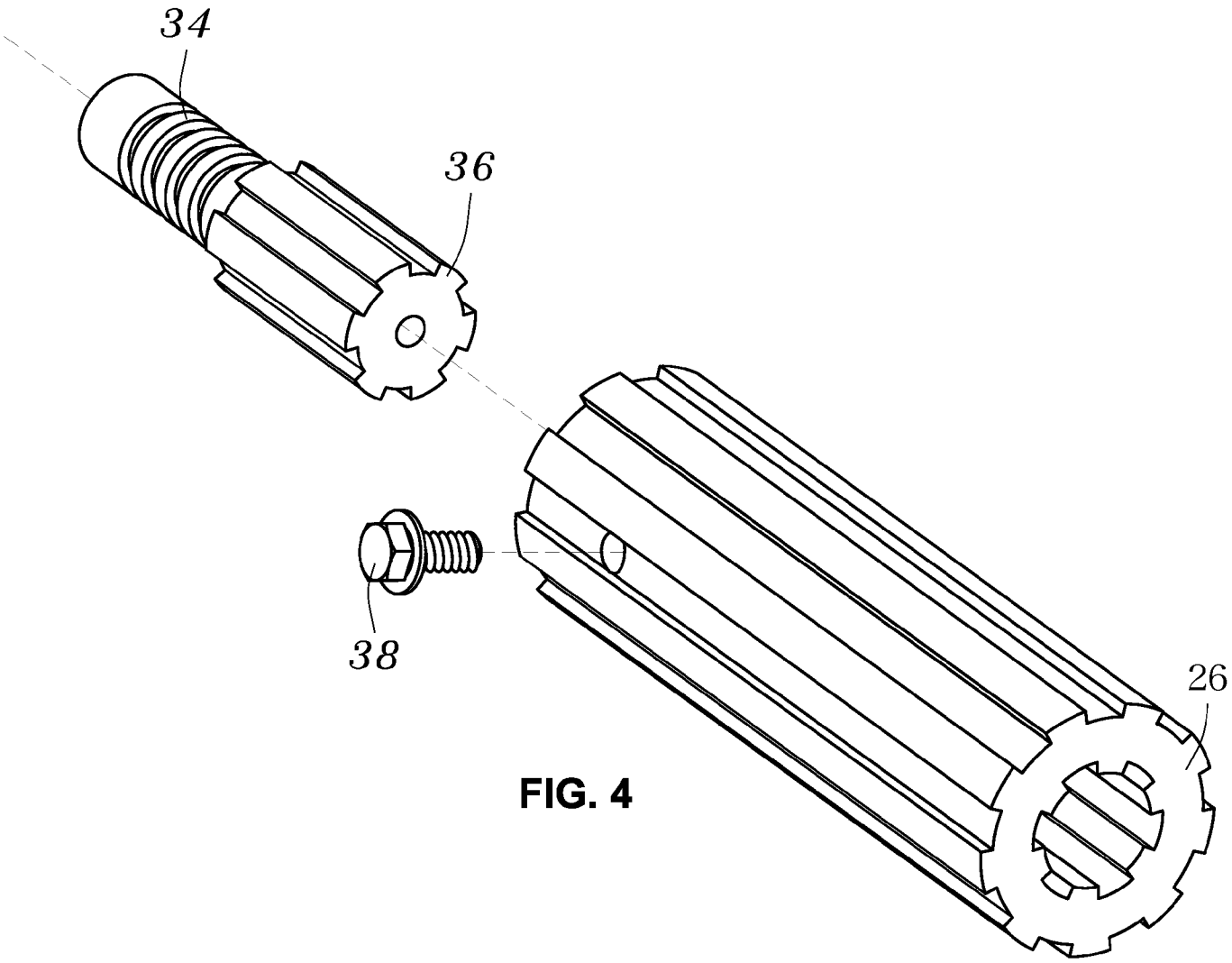
FIG. 4 is a line drawing showing the connection of the spline drive shaft to the spline collar.

As illustrated in FIG. 4, the opposite end of the hollow spline drive shaft 26 slides over the spline shaft 36, which is mounted on threaded shaft 34. FIG. 4 illustrates how the spline shaft 36 may be secured to splined drive shaft 26 using connection bolt 38. The manufacture of the spline shaft as a keyway to the splined drive shaft is performed using broaching. The use of a spline broach is contemplated for manufacture of such a pairing. Use of the paired spline shafts provides for very powerful torqueing while limiting axial movement. A disadvantage of helical drive gears, such as that illustrated in FIG. 11 of U.S. Pat. No. 7,377,485, to Davis, is that the thrust is along the axis of the drive gear. This disadvantage of helical gears requires accommodation through the use of thrust bearings and lubricants to offset the addition sliding friction between the meshing teeth.

Figure 5:
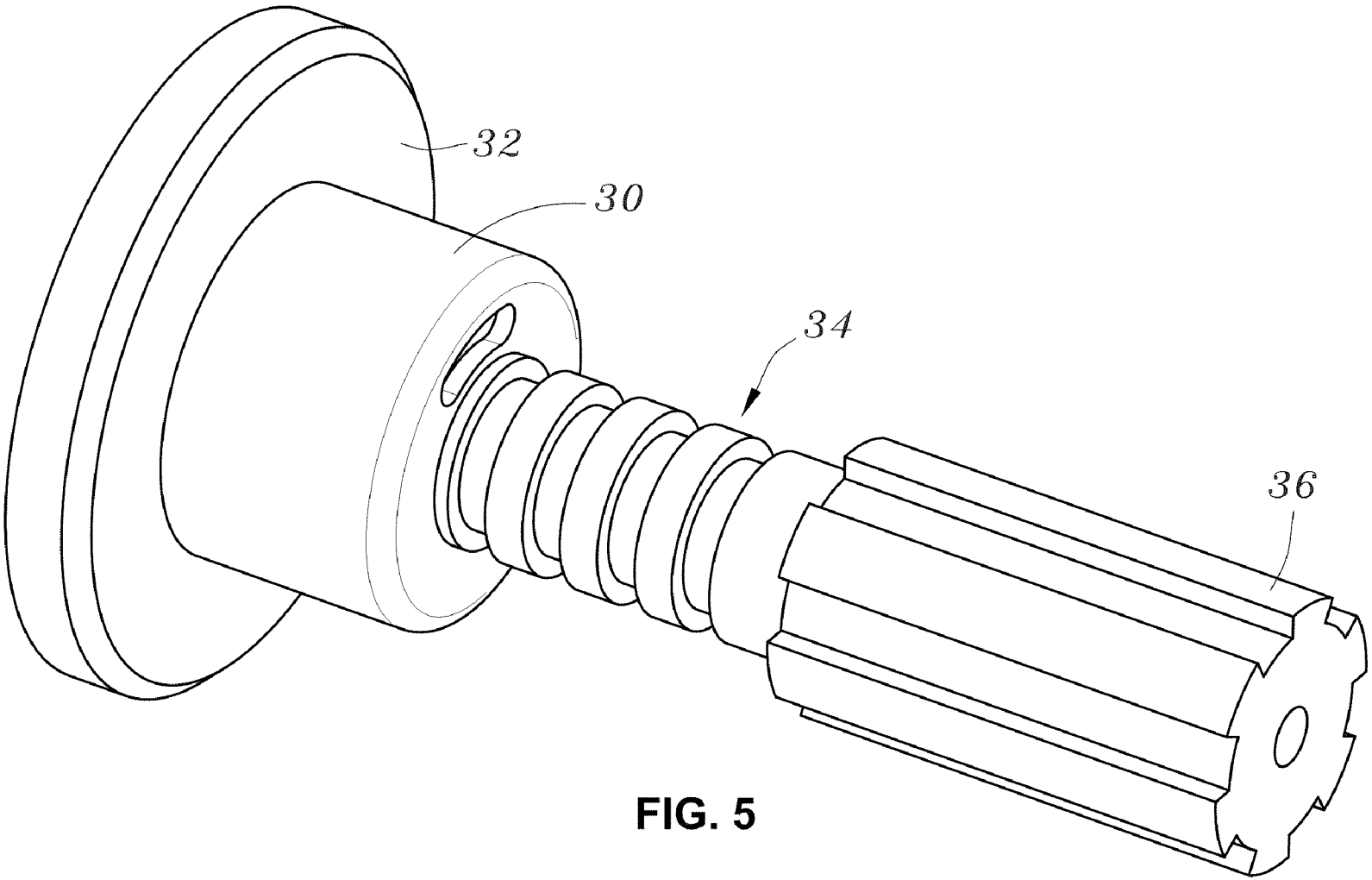
FIG. 5 is a line drawing showing the components of the winch assembly.

As illustrated in FIG. 5, the spline shaft 36 is mounted on threaded winch shaft 34, which extends through shaft spacer collar 30. Although the spline shaft is generally universal and fits most winches, depending on the type of winch being retrofitted, there might be need for an additional fitting device, shown here as optional fiber disc 32.

Figure 6:
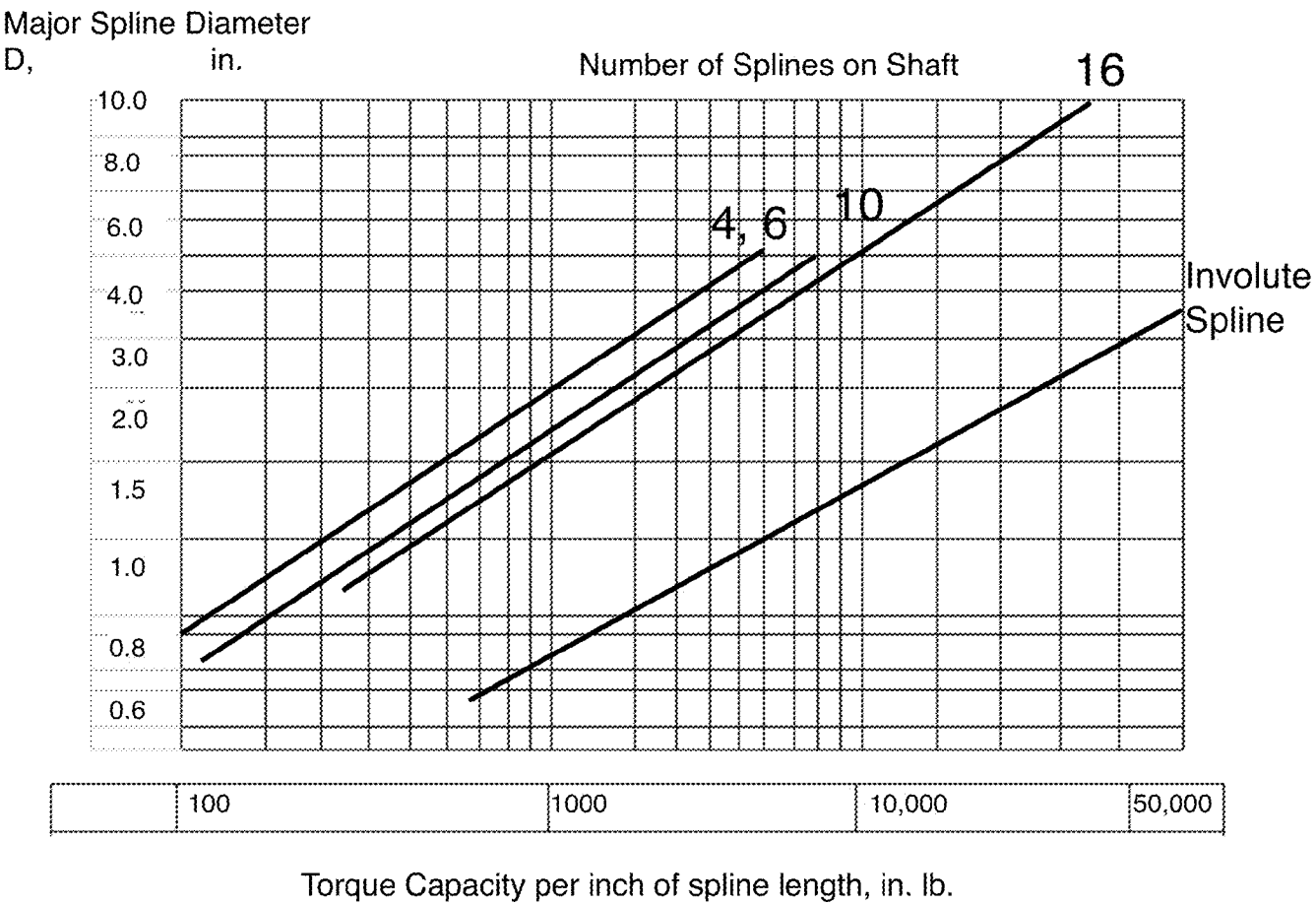
FIG. 6 is a graph showing Torque Capacity of a spline shaft.

As illustrated in FIG. 6, the torque capacity of a spline shaft increases as the length of a spline drive shaft increases. FIG. 6 shows that when a shaft increases the number of splines from 4 or 6, to 10 and then to 16 splines, the torque capacity, per inch, also increases. FIG. 6 also shows that in addition to a straight spline shaft, the use of an involute spline shaft can further increase torque capacity within the present invention.

Although not intended as limiting, one preferred example of a spline shaft contemplates having a range of from about 10 to about 30 exterior spline teeth, more preferably from about 15 to about 25 spline teeth, and more preferably about 20 spline teeth.

Although not intended as limiting, further preferred examples of a splined drive shaft contemplate having dimensions of a spline root diameter range of from about 1.118 to about 1.113 inches, and/or a spline outside diameter range of from about 1.260 to about 1.255 inches, and/or a chord dimension over two splines of from about 0.278 to about 0.277 inches, and/or a bore diameter for broaching of from about 1.145 to about 1.146 inches. These ranges are intended to describe in a non-limiting manner the manufacturing specifications necessary to make the featured part, the splined drive shaft, but which also delineate the outer dimensions of the keyway spline shaft in order to fit within the bore.

Considering the use of the present inventive subject, the method of installing the boat lift motor comprise the steps of: (i) exposing the winch axle of a boat winch lift; (ii) installing a spline shaft on the winch axle of the boat winch lift; (iii) sliding a splined drive shaft of a motor and control unit onto the spline shaft; and (iv) securing the motor and control unit to a structural part of the boat winch or a related structure on a dock.

In another preferred embodiment, the method includes the step of sliding a spacer collar onto the winch axle before installing the spline shaft on the winch axle. In an alternate preferred embodiment, the method further requires the installing of the spline shaft to comprise threading the spline shaft onto a threaded winch axle.

In a further preferred embodiment, the method further comprises wherein the motor and control unit have a power outage access so the lift can be lowered or raised using an external source in a power outage.

The power input cord can be configured for either a 120 VAC power source or a DC battery power source. The DC motor is preferably 120 VDC when used with an AC power source and 12/24 VDC when used with a DC battery power source. The electronics housing, worm gear reducer components, spline drive shaft, splined bushing, connection bolts and winch are made of durable material such as steel. Since the invention is used outdoors and often gets wet, the steel or similar material used to produce these metal components is preferably treated with a salt bath carbonitriding or another, similar rust-proofing process. The lift cable is preferably comprised of stainless steel wire in a gauge sufficient to safely support the weight of the boat to be lifted. Alternate lift cable compositions could include rope or metal chain.

It will be clear to a person of ordinary skill in the art that the above embodiments may be altered or that insubstantial changes may be made without departing from the scope of the invention. Accordingly, the scope of the invention is determined by the scope of the following claims and their equitable Equivalents.

What is claimed is:

1. A boat lift system, comprising a motor, such motor driving a worm gear reducer which, in turn, rotates a tubular drive shaft, said tubular drive shaft having a plurality of radial splines running its full length, both inside and outside; wherein the tubular drive shaft is connected at a proximal end to the motor, and a distal end of the tubular drive shaft overlays a spline shaft mounted on an axle of a winch; wherein the winch is rotated to wind and unwind a cable, rope, cord or chain; and wherein the motor is engaged and disengaged by an electronic controller which opens and closes a relay based on user command.

2. The boat lift system of claim 1, further comprising wherein the motor is comprised of a DC motor with a voltage sufficient to produce the torque necessary to raise and lower boats of a weight up to about 7000 pounds.

3. The boat lift system of claim 1, further comprising wherein the motor comprised of an AC motor with a voltage sufficient to produce the torque necessary to raise and lower boats of a weight up to about 7000 pounds.

4. The boat lift system of claim 1, further comprising wherein the motor is a 12 or 24 volt motor that draws DC power from a battery.

5. The boat lift system of claim 2, further comprising wherein the DC motor is a 120 volt motor that draws 120 volts of alternating current power.

6. The boat lift system of claim 1, further comprising wherein the splined tubular drive shaft is constructed from steel.

7. The boat lift system of claim 1, further comprising wherein the winch has a threaded axle shaft, and wherein the spline shaft is threaded onto said axle shaft.

8. The boat lift motor of claim 1, further comprising wherein the boat lift motor is controlled via a remote control in communication with the electronic controller.

* * * * *